US008227677B2

(12) United States Patent
Wilk

(10) Patent No.: US 8,227,677 B2
(45) Date of Patent: Jul. 24, 2012

(54) VALVE FOR WIND INSTRUMENT

(76) Inventor: Martin A. Wilk, Palmyra, IN (US)

( * ) Notice: Subject to any disclaimer, the term of this patent is extended or adjusted under 35 U.S.C. 154(b) by 654 days.

(21) Appl. No.: 12/455,986

(22) Filed: Jun. 10, 2009

(65) Prior Publication Data

US 2010/0236379 A1 Sep. 23, 2010

Related U.S. Application Data

(60) Provisional application No. 61/210,378, filed on Mar. 18, 2009.

(51) Int. Cl.
*G10D 7/10* (2006.01)

(52) U.S. Cl. ..... 84/395

(58) Field of Classification Search ..... 84/380 R, 84/387 R, 387 A, 395, 396
See application file for complete search history.

(56) References Cited

U.S. PATENT DOCUMENTS

| | | | |
|---|---|---|---|
| 222,248 | A | 12/1879 | Conn et al. |
| 245,863 | A | 8/1881 | Reny |
| 798,025 | A | 8/1905 | Ellis |
| 966,700 | A | 8/1910 | Neely |
| 1,112,120 | A | 9/1914 | Conn |
| 1,343,883 | A | 6/1920 | Calderwood |
| 1,924,399 | A | 8/1933 | Fiorino |
| 1,932,742 | A | 10/1933 | Kull |
| 2,259,756 | A | 10/1941 | Lindsay |
| 2,260,723 | A | 10/1941 | Olds |
| 2,612,811 | A | 10/1952 | Meyers |
| 2,665,606 | A | 1/1954 | Wohlrab |

(Continued)

FOREIGN PATENT DOCUMENTS

EP 1837855 A2 9/2007

OTHER PUBLICATIONS

The Rene Hagmann Free-Flow Rotary Valves, http://trombone.ch/pages/fram1.html.

(Continued)

*Primary Examiner* — Kimberly Lockett
(74) *Attorney, Agent, or Firm* — Valenti Hanley & Robinson PLLC; Kevin T. Duncan

(57) ABSTRACT

The present invention provides a valve assembly designed to regulate air flow through a musical instrument and is designed to avoid bumps typically associated with valve construction that result in distortion and other harmful effects on vibrating columns of air that pass there-through. The valve assembly comprises: a cylindrical-shaped valve casing having openings formed therein that define at least one ingress and at least one egress through which vibrating columns of air pass; and a valve piston received within the valve casing and linearly displaceable therein, the valve piston comprising at least one passageway having a cross-section that is open and u-shaped, whereby other passageways formed in the valve piston are bump-free. The present invention also provides a valve assembly comprising: a cylindrical-shaped valve casing having openings formed therein that define at least one ingress and at least one egress through which vibrating columns of air pass; and a rotary valve received within the valve casing and rotatably displaceable therein. The rotary valve comprises a pair of passageways formed asymmetrically in the body of the rotary valve and at least one of the pair of passageways having a substantially circular cross-section. The rotary valve being further characterized with a land between opening of one of the pair of passageways and the absence of a land for the other of the pair of passageways so as to minimize distortion.

25 Claims, 8 Drawing Sheets

U.S. PATENT DOCUMENTS

| | | | | |
|---|---|---|---|---|
| 2,798,401 | A | 7/1961 | Miller | |
| 2,990,744 | A | 7/1961 | Brilhart | |
| 3,886,837 | A | 6/1975 | Veneklasen | |
| 3,973,464 | A * | 8/1976 | Novy | 84/392 |
| 4,047,459 | A | 9/1977 | Nakamura | |
| 4,996,902 | A | 3/1991 | Hulot | |
| 5,361,668 | A | 11/1994 | Andersen et al. | |
| 6,297,436 | B1 * | 10/2001 | Adams | 84/388 |
| 7,112,735 | B2 | 9/2006 | Shire | |
| 7,161,077 | B1 | 1/2007 | Fry et al. | |
| 2006/0219083 | A1 | 10/2006 | Wasser et al. | |
| 2009/0038463 | A1 | 2/2009 | Fujii et al. | |

OTHER PUBLICATIONS

Robert Miller, The Miller Valve: A Patented New Rotary Valve Design for Brass Musical Instruments, http://www.millervalve.com/tech.html.

PCT International Preliminary Report, PCT/US2010/000488, September 29, 201, 6pgs.

* cited by examiner

PRIOR ART

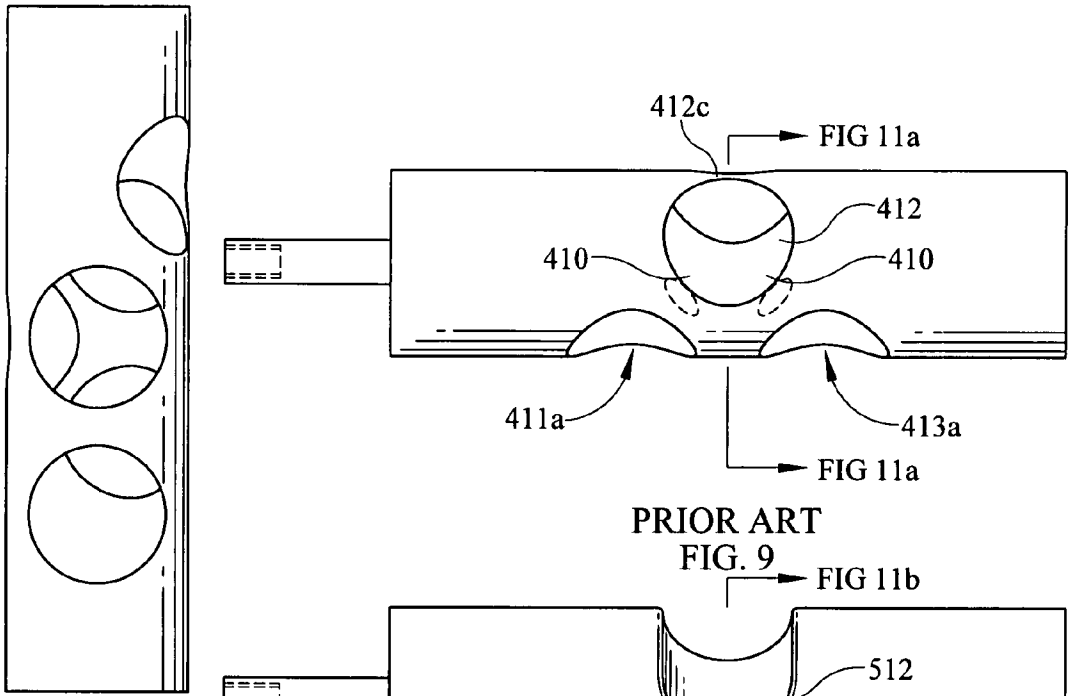
PRIOR ART
FIG. 8
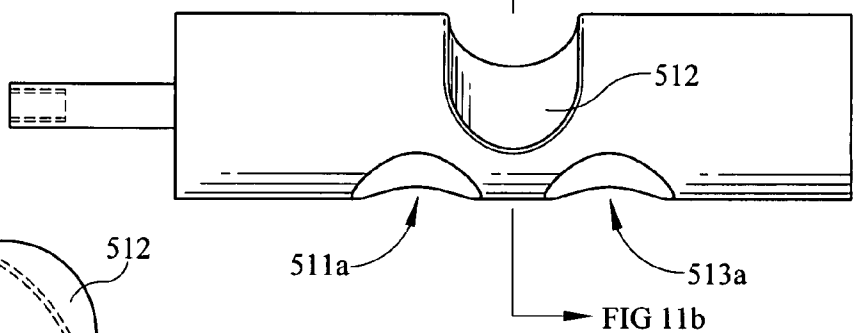
PRIOR ART
FIG. 9
FIG. 10
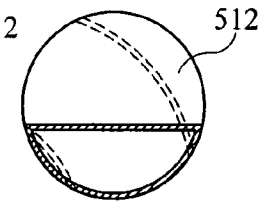
FIG.11b
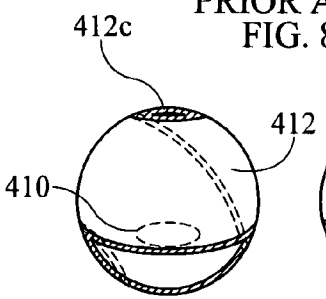
PRIOR ART
FIG. 11a

VALVE FOR WIND INSTRUMENT

CROSS-REFERENCE TO RELATED PATENTS

This invention is related to and claims benefit of priority to U.S. Provisional Patent Application No. 61/210,378 filed Mar. 18, 2009, and entitled Piston Valve For Wind Instrument, the entirety of which is hereby incorporated by reference.

FIELD OF THE INVENTION

This invention relates to musical instruments, in particular wind instruments, and, more particularly, to musical instruments having piston valves through which columns of air travel to produce sound.

BACKGROUND OF THE INVENTION

Wind instruments are of a variety of types and typically involve a player of the instrument forcing vibrating air columns into an input opening or mouthpiece of the instrument so that the air column travels through the length of the instrument and out the bell or output opening of the instrument. Along the path length altering loops and valves may be placed, such as for trumpets, to alter the length the air column has to travel before exiting the instrument and producing sound. It has been common knowledge for centuries that air columns of differing length produce musical notes of differing pitch. An example of an instrument based upon this principle is a pipe organ. Such organs have a multiplicity of pipes of varying lengths (as well as diameters) but the length of a particular pipe (and the air column therein) does not change. Other examples include cornets and trumpets which use linearly-actuated valves and French horns which use rotary valves, all to change the note(s) produced by the instrument. In these latter examples, such note changes are by valving tubing of various lengths into or out of the air column "circuit," thus changing the length of the air column as measured from the instrumentalist's lips or actually he rim of the mouthpiece to the bell from which sound is emitted.

The term "brass musical instrument" is used herein in its conventional usage in the art, to denote a musical instrument that defines a length of tubing, and which has at one end a "cup mouthpiece" to receive a player's lips and has at the other end a flared opening or bell from which the sound emerges or emitted. The sound is generated when a player vibrates their lips and, simultaneously, forces a vibrating air column through the mouthpiece, the length of tubing and out the bell. As is well known, such so-called "brass musical instruments," while often being made of various metals, including brass, are also known to be made in whole or in part of other materials, including fiberglass, plastics, carbon fiber, etc.

Conventional brass musical instruments that are constructed to be at least in part chromatic, or to play notes other than those found in the harmonic overtone series of the basic flow path defined by the instrument, include mechanisms for effectively changing the length of the tubing within the instrument through which a vibrating column of air generated by the player's lips passes. By changing the length of the tubing, a different harmonic overtone series is established that allows the generation of additional notes. Conventionally, the length of tubing may be changed by either of two primary mechanisms. A first mechanism, as used in a modern trombone is through use of an easily moveable slide, through which the length of the tube may be changed as desired by the player to facilitate the playing of all notes in a scale. The second mechanism is through the use of valves, which are selectively actuated to change the length of tubing. In modern instruments, the actuation of a valve alters the flow path of the instrument to add a given length of tubing which is sufficient to lower the harmonic series a given increment, or number of notes. Some instruments may include multiple valves for adding multiple lengths of tubing to a flow path of the instrument. For example, a modern instrument that is intended to be chromatic may include three valves, wherein the first valve lowers the harmonic series, by two steps or chromatic notes, the second valve lowers the harmonic series by a single step or note, and the third valve lowers the harmonic series by 3 chromatic steps or notes.

Air flow valves having a variety of different configurations, structures and other operative features have been used on musical instruments in the brass and/or wind family for over a hundred years in order to provide the musician playing the instrument with a greater range in terms of both pitch and tonal quality. Generally speaking, such flow path selector valves, particularly of the type used with brass-wind instruments, are either of the rotary type or alternatively, are of the piston and cylinder type. In the latter category, also commonly referred to as Perinet valves, a piston is longitudinally slidable within a cylinder against a biasing force. The piston normally has both a longitudinal bore and transverse bore which enable air to be conducted along a shorter or longer path of travel, in order to selectively vary the tonal quality of the instrument. Passages formed in this type of valve are generally round in cross section, and thereby, permit free flow of air therethrough which is desirable for achieving increased sound volume and a high quality tones. The other category of air flow valves relates to rotary valves, which typically include a valve disk which is provided at its periphery with air inlets and air outlets. These air inlets and outlets are generally disposed to communicate with one another through radial passages.

Rotary valves have been in existence since around 1832. The rotary valve design has been attributed to Joseph Riedl of Vienna, Austria. The rotary valve is disc-shaped and is actuated in a rotating motion, as opposed to piston valves that are actuated linearly. Rotary valves comprise a valve disc, which is provided at its periphery with air inlets and air outlets that communicate with each other through radial or sector-like passages. Rotary valves provide for fast playing due to the short actuating stroke of the design. Although rotary valves allowed for fast play and addressed some playability issues, they have drawbacks. One problem with the traditional rotary design is that sharp edges and constrictions formed in the disc deflect the vibrating air column flowing in the air passages to such a degree that the sound volume and the quality of the tone as well as the ease with which the tone can be produced are adversely affected. For example, common disc-shaped rotary valves have pieces of tubing (those switched into and out of the circuit by the valve) fastened to the valve casing generally radially and using rather sharp bends. And the internal valve passages themselves involved some rather sharp bends. These constrictions or "convolutions" in the air flow path add additional resistance to the flowing air column and adversely affect musician's "blowing power" by limiting the maximum volume that a musician can obtain, and also undesirably affects tonal quality.

Yet another difficulty with known rotary valves is that even though the stationary tubing attached to the valve casing is circular in cross-section, the passages in the rotating valve piston are often ellipsoid (or, perhaps of some other shape) but not circular. As a result, there is an abrupt flow discontinuity where the non-circular passage and the circular tube intersect. The tonal quality of the instrument is thereby adversely affected. Such a valve is said to lack "flow tangency." Flow tangency is achieved when the edges of two adjacent openings, e.g., a passage exit opening and the adjacent tube entry opening (or a tube exit opening and the adjacent passage entry opening), are in registry. When so configured, there is a smooth transition surface (substantially devoid of discontinuity) over which air can flow.

A widely adopted valve configuration used in many wind instruments over the past century and widely used today is the Perinet piston valve. The Périnet valve is a piston valve, named after Francois Périnet, that first came into prominence around 1838 and comprises a cylindrical casing in which a cylindrical piston is longitudinally displaced in sliding relation within the casing against a spring force for manual actuation. The piston has longitudinal and transverse bores so that the air can be conducted along a shorter or longer path for a generation of different tones. The passages are round in cross-section so that they permit of a free flow of the air column traveling therethrough; this is desirable for achieving a large sound volume and a high quality of the tone. But the long actuating stroke and the high inertia of said valves oppose a fast playing. The valve loops are arranged in such a way that the inlet tubing is positioned on a different level than the outlet tubing. The piston is held at rest by a spring, which is placed either on top (top-sprung) or below (bottom-sprung) the piston. The Périnet valve is now the standard for trumpets in most countries (except Germany and Austria where rotary type valves are more common), and is often simply called the "piston valve."

FIGS. 1 and 2 depict cross-sectional views of a prior art Perinet valve assembly in an open or un-actuated position (FIG. 1) and in an actuated position (FIG. 2) in which parts of a piston valve are as follows: a=valve casing; b=piston; c=valve loop with slide; d=main tubing; e=port; f=touchpiece, finger tip, lever; g=valve stem; h=top valve cap; i=baluster; k=lower valve cap; l=return spring; m=guiding slot in stem/piston; n=key; and o=keyway for piston valve guide in casing. In the unactuated position of FIG. 2, the air column enters the valve assembly from a lead pipe (not shown) at inlet port 102 of the valve casing (a) and travels through the lower windway or passage formed in the piston (b) and out through main tubing (d). In the actuated position of FIG. 2, the air column also enters the valve casing (a) from the lead pipe through the same inlet port but now travels through the middle windway or passage formed in the valve piston (b) out of the valve piston and through valve loop (with slide) (c) and back into the valve assembly and travels through the upper windway or passage and exits through main tubing (d). These windways, depending on orientation and function, may be referred to as "switching" or "return" windways. A problem commonly associated with Perinet valves is that due to physical constraints associated with placing liners (or troughs or tubular material) that form the upper, middle and lower windways within the openings formed in the piston and disposing the liners within the hollow inner volume of the piston body, tradeoffs have been made that adversely affect tonal quality and volumetric capacity and laminar flow of the air column passing through the Perinet valve. In particular, the manufacturing of the piston valve due to the size constraints within the narrow hollow piston body results in "lumps" or "bumps" being formed in at least one and typically two of the windways.

With reference to the prior art valve assembly of FIGS. 1 and 2, the piston valve consists of a cylindrical outer casing (a) and the piston (b) inside, which fits tightly within the outer casing. The valve loop (c), as well as the main tubing (d), are soldered to the outer casing. The piston is perforated with ports (e) that lead the air column either straight through the main tubing or into the valve loop. The valve loop is disengaged or engaged by the up-and-down movement of the piston within the casing that aligns the ports either with the main tubing or the valve loop. Traditionally, circular in cross-section passages are provided through the valve assembly and the cross-section of the passage is preferably about the same as the bore of the windpipes or passages. Accordingly, the casing and piston of the valve assembly are fabricated to conform in size and shape cross-sectionally to the windpipes. This results in less than generous space in the valve piston in which to form switching and return passages. Another common consideration in the design of piston valves is the desire to make the actuation stroke as short as possible to enhance speed of play. Unfortunately, this leads to the drawback of further constricting the amount of space available for forming the windways or passageways in the piston body.

For example, FIG. 3 depicts an elevation view of a prior art Perinet valve piston with valve casing in cross-section as disclosed in U.S. Pat. No. 1,112,120 (Conn) entitled Cornet-Valve. As shown in the figure, lumps 302 are formed in the middle "port" 3 formed transversely through the piston valve 2. As stated above, the goal is to provide a circular in cross-section windway through which air columns travel so as to minimize deflection and interruption of the air column. Harmonics also play a role in the configuration of the valve, valve loop, etc. Lumps formed as an artifact in the manufacturing process represent irregularities in the surface of the windway and cause distortion in the air column passing through the windway. In order to provide the shortest actuation stroke possible, the windways are brought together as close as possible and the size of the windways is restricted. This has the unfortunate effect of increasing the severity of the lumps and limiting the volumetric capacity and flow of the valve. What is needed is a valve piston design that removes or minimizes the lumps resulting from manufacturing the windways and increases volumetric flow capacity. What is also needed is a method of manufacturing valve pistons that address these problems while providing structural integrity and stability.

Accordingly, there is a need in the musical industry for an improved flow regulating valve assembly for use on a musical instrument such as, but not limited to, a brass type of wind instrument.

SUMMARY OF THE INVENTION

Advantages associated with the various uses and embodiments of the present invention include the following: sound wave paths less constricted; combination (hybrid) of piston and rotor valves; hollow piston with sheet metal rotor passage; unimpeded (from bumps) wind ways; improved response and playing characteristics (all registers) flexibility and clarity, e.g., slurring, sound response; increased energy transfer due to improved flow characteristics; reduced back-pressure or resistance in both open and actuated conditions; extra strong trough insures piston rigidity; simpler to manufacture as the balling stage is eliminated for one passage; the effective piston to casing sealing area is essentially functionally unchanged from a regular piston; one less vertical member (land or wed) to align; less vertical interval web protrusion within the valve itself; can be made with minimal changes in manufacture techniques, materials; rotor-like passage in present invention can be used for ingress or egress of the vibrating air column when the switching loop is employed; employs the valve casing as both a sealing surface and a wind way simultaneously when the piston is activated;

no change in piston stroke length or felting/corking when compared to the normal valve; no change in casing appearance when this invention is in place; the inventive system piston can be refit in same manner as regular piston; less surface area on contact surface of valve, reducing friction; no change in casing or slide loops needed when converting to present invention; produces beneficial acoustical effects in a hybrid piston/rotor like passage valve. The invention may be used in conjunction with different types of valve designs including, for example, Perinet, rotary (hollow or solid), Berliner, Allen, and other hollow valve designs.

In one embodiment, the present invention provides a valve assembly designed to regulate air flow through a musical instrument. The valve assembly comprises: a) a cylindrical-shaped valve casing having openings formed therein that define at least one ingress and at least one egress through which vibrating columns of air pass; and b) a valve piston received within the valve casing and linearly displaceable therein, the valve piston comprising at least one passageway having a cross-section that is open and u-shaped, whereby other passageways formed in the valve piston are bump-free.

In another embodiment, the present invention provides a valve assembly designed to regulate air flow through a musical instrument. The valve assembly comprises: a) a cylindrical-shaped valve casing having openings formed therein that define at least one ingress and at least one egress through which vibrating columns of air pass; and b) a rotary valve received within the valve casing and rotatably displaceable therein, the rotary valve comprising at least one passageway having a substantially circular cross-section that mitigates distortion.

In yet another embodiment, the present invention provides a valve assembly designed to regulate air flow through a musical instrument. The valve assembly comprises: a) a cylindrical-shaped valve casing having openings formed therein that define at least one ingress and at least one egress through which vibrating columns of air pass; and b) a rotary valve received within the valve casing and rotatably displaceable therein, the rotary valve comprising a pair of passageways formed asymmetrically in the body of the rotary valve and at least one of the pair of passageways having a substantially circular cross-section. The rotary valve being further characterized with a land between opening of one of the pair of passageways and the absence of a land for the other of the pair of passageways.

Advantages of the various embodiments of the present invention include increase in volumetric flow, improved laminar flow, improved intonation and sound quality, improved alignment, "bumpless" relatively unimpeded windways or passageways within valve bodies, and less surface area in contact with the valve casing by removing webs or lands. The invention may be used in fabricating new instruments and pistons or in retrofitting existing valve pistons. Removing webs may also alleviate leading edge issues when transitioning valves from engaged to unengaged positions as well as alignment issues. The invention has application in both piston and rotary valve applications.

BRIEF DESCRIPTION OF THE DRAWINGS

In order to facilitate a full understanding of the present invention, reference is now made to the accompanying drawings, in which like elements are referenced with like numerals. These drawings should not be construed as limiting the present invention, but are intended to be exemplary and for reference.

FIG. 8 is a perspective view of a valve piston body with windway passage holes formed therein;

FIG. 9 is a perspective view of a partially completed prior art Perinet valve having a middle passageway formed therein;

FIG. 10 is a perspective view of a partially completed valve according to the present invention with a formed middle passageway;

FIG. 11*a* is an end view taken at the cross-section as shown of the partially completed prior art Perinet valve of FIG. 9;

FIG. 11*b* is an end view taken at the cross-section indicated on the partially completed valve of FIG. 10 in accordance with the present invention;

DETAILED DESCRIPTION OF THE INVENTION

Figures 1, 2:
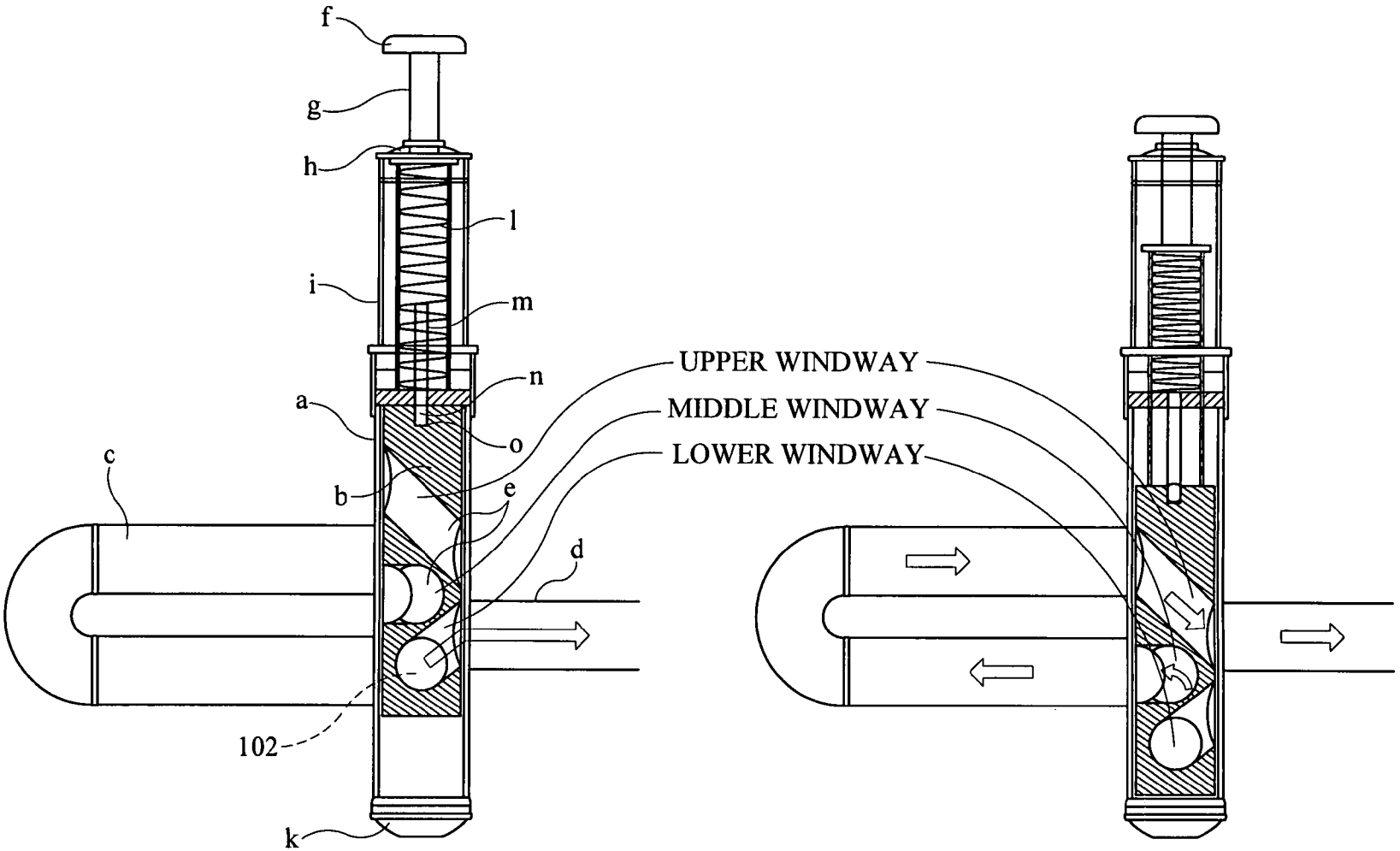
FIG. 2 PRIOR ART
FIG. 1 is a cross-sectional view of a prior art valve assembly with the valve piston in the un-actuated position.
FIG. 2 is a cross-sectional view of the prior art valve assembly of FIG. 1 with the valve piston in the actuated position.
Figure 3:
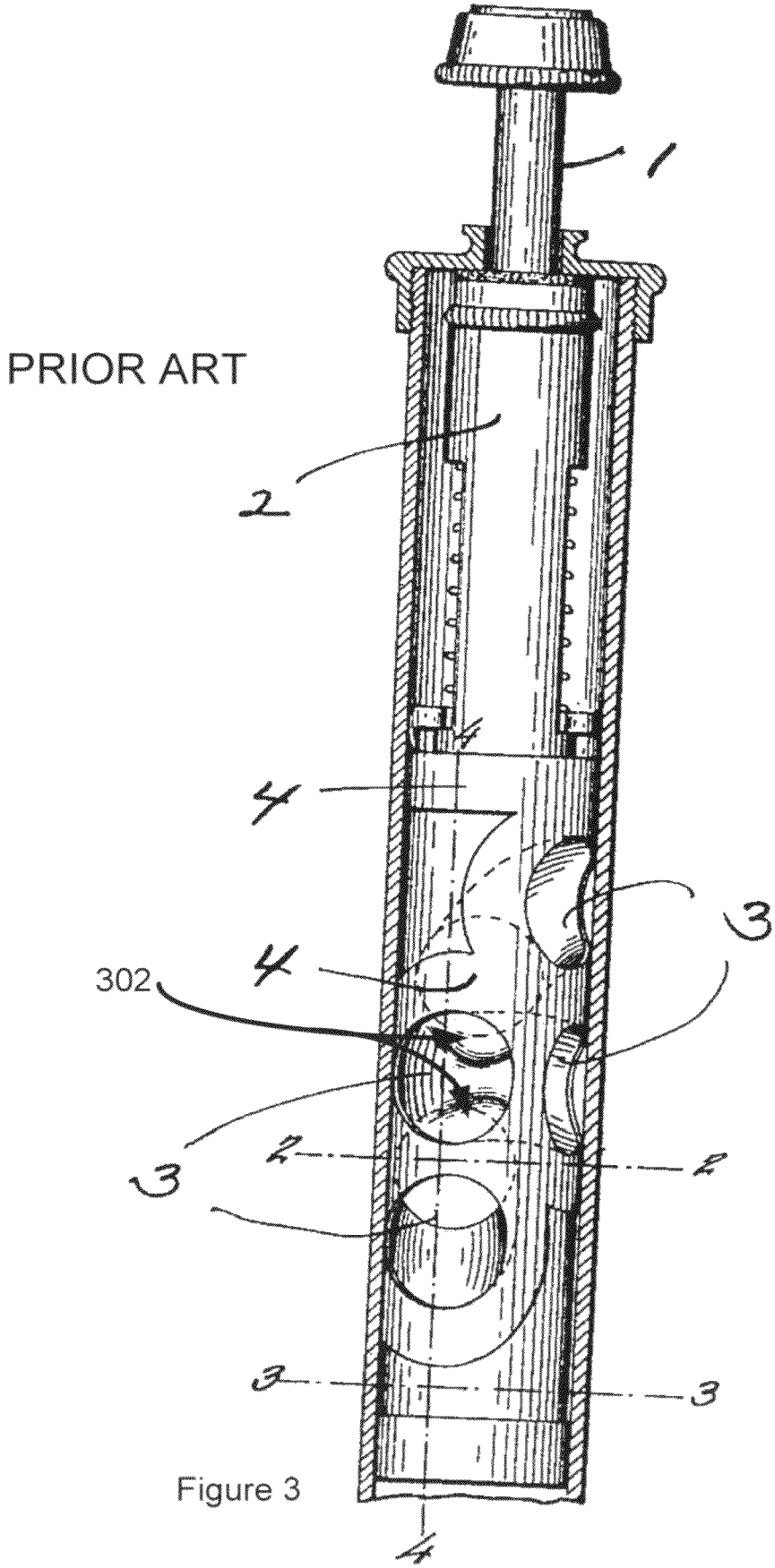
FIG. 3 is an elevation of a prior art Perinet valve piston with valve casing in cross-section.

The present invention will now be described in more detail with reference to exemplary embodiments as shown in the accompanying drawings. While the present invention is described herein with reference to the exemplary embodiments, it should be understood that the present invention is not limited to such exemplary embodiments. Those possessing ordinary skill in the art and having access to the teachings herein will recognize additional implementations, modifications, and embodiments, as well as other applications for use of the invention, which are fully contemplated herein as within the scope of the present invention as disclosed and claimed herein, and with respect to which the present invention could be of significant utility.

The Perinet valve is manufactured by determining a final outside diameter and length of piston and piston casing to base the instrument design. Next, six holes are located along the length of hollow, cylindrical tubing that forms the piston body. In one exemplary configuration, the holes are grouped in pairs and each of three pairs of holes is connected by a liner or trough (fabricated by insertion of a filler crook into the inner hollow body of the piston) to form windways for directing and communicating vibrating columns of air through the valve assembly and instrument. The holes form openings located on the piston to provide ingress and egress openings for the air columns that travel through a windway formed by fabricating a passageway that connects opposite openings that line up with loops formed in the wind instrument. In fabrication, holes are drilled into or otherwise formed in the hollow tube structure that makes up the valve body, such as the holes shown on the exemplary valve body of FIG. 8.

For a typical Perinet valve, six holes are formed along the length and circumference of the valve body and are locate to line up with loops formed in the instrument valve casing when the completed valve is placed in the valve casing. In this manner, the valve permits columns of air to travel through the instrument when in an open (or non-actuated) position, in an actuated position, and even partially when in a partially actuated position. The drill holes, i.e., the entire diameter prior to filler crook insertion, equals the bore size plus two times the wall thickness of tubing to be used as filler crook, i.e., the material inserted into the hollow valve body between a pair of openings to form a windway. In the typical six hole configuration there are six holes, three pairs of holes and three windways, although other configurations are contemplated by the invention. The fabricator locates the key and drill location hole for future valve guide or key. Parts must be oversized as the piston is ground to dimension once filler crooks or windways are installed.

Filler crooks (windway tubes) are installed by inserting or placing them within respective pairs of the six (three pairs) piston holes previously drilled. Filler crooks, for example, may be approximately 0.014 to 0.015 in wall thickness, depending on manufacturer and instrument type. Filler crooks can be hollow-bent or filled with a supportive material and then bent to form. Filler crooks are forced into windway passages. Filler crooks are then secured into position either by hand pressure or by flaring out one or both ends of the tubes so that the tube will not slip into and through the appropriate piston hole during the next operation (balling out). Once filler crook tubes (undersize from final bore size) are in position, they are expanded to final internal dimension size through the use of a series of balling tools as is known in the art.

For example, balling tools are loaded into a horizontally mounted bench motor and coated with lubricant (dry Ivory soap). The ball is spun and forced through piston windway passages. Usually graduated balling tools are used (e.g., three sizes) to achieve a final (e.g., 0.459) bore size. Preferably, the filler crooks are as close to final bore size as possible prior to the balling stage. Final balling is done from both sides of each hole as the balling device is not capable of making sharp windway turns (i.e., each halfway or slightly more). Next, the part is degreased after all three windways are loaded into the piston valve body.

Due to the special constraints within the valve body and the bore size of the horn and the size of the filler crook tubes, lumps are formed during the balling process. Depending on the fabrication and desired location of the lumps, the lumps, typically two, may be located in any of the one or two of the three passageways, for instance, both lumps may be located in the middle passageway, one lump may be in each of the upper and lower passageways, one lump in each of the upper and middle passageways, or one lump in each of the middle and lower passageways. Usually the lump is split between the "open" passage (no valves depressed) and the activated passage (valve depressed). If the lump were pushed completely toward the middle passage of the valve, this would make the valve play very well (no bumps) in the open position but very poorly in the activated (valve depressed) position. This switching tube would then have a lump both top and bottom internally. To compromise, one of the two lumps is typically pushed downward from the middle tube to form in the lower passageway or windway, while the other lump is pushed up from the middle tube into the top or upper windway to achieve playing uniformity of valved and non-valved notes (not quality).

Once the filler crooks are in place and sized, they are degreased, fluxed and brazed in place. Some makers soft-solder the filler crooks in place, not braze. Brazing, for example, means temperatures exceeding approximately 1,200° Fahrenheit (depending on braze used). Brazing softens (heats to red hot and anneals the piston) and reduces the hardness of the piston. Once brazed, the piston may have a top and bottom installed (soft- or hard-soldered, or brazed, into place). The piston is then turned down on lathe to eliminate excess filler crook tubing and braze protruding from piston surface. The piston stem hole is drilled and tapped and the piston is then ground to dimension, either centerless or between centers, and the piston then has a flat machined on the piston for valve guide recess. The piston is then lapped to mate with casing interior (use of approximately 600 grit), preferably with a garnet lapping compound. The valve guide or key is installed into keyhole after keyhole has been drilled and tapped. The piston stem may or may not be soft-soldered into place to prevent stem removal when finger button is removed. Note that this description is one exemplary manner of manufacturing a bottom-sprung Perinet piston (bottom-sprung pistons usually used in lower brass instruments such as baritones, euphoniums, tubas). The invention is not limited to bottom-sprung instruments and is intended for beneficial use in top-sprung valve configurations as well, for instance. By way of example, and not limitation, the final valve to valve casing is usually of a tolerance of 0.0005 to 0.001 inch. A piston of bore size 0.459 (internal windway passage diameter) is approximately 0.666 in overall piston diameter. The piston would slip into a casing which has an internal diameter (id) of 0.666 plus tolerance, say 0.6665 inch or as large as 0.6667 inch, depending on the design and manufacturing skill of the maker or capabilities of the process to the extent mechanized.

In keeping with the present invention, pistons or valves may be manufactured initially with the invention or as a retrofit or reworking of an existing valve to include the present invention. In retrofitting a valve, piston modification is done by: resizing topmost and bottommost filler crooks (operating as passageways or windways). This is done by forcing progressively larger and larger dent balls into, through and out the openings of the valve corresponding to those upper and lower windways. This pushes the lumps to the middle passageway (top passage and bottom are accurately sized). The piston may be checked for straightness and corrected if needed.

The middle passage filler crook is carefully ground away and the middle passage holes are then cleared of all old metal and braze. The lateral valve body material that forms the lateral "land" or "web" that separates the middle passage holes (two), or first pair of openings, is removed thereby effectively forming a "trough" across the body of the valve that maintains the extreme transverse limits of the middle passage. Preferably, Monel sheet metal (0.031" thickness—a thickness preferably thicker than the thickness of the typical filler crook tube material, e.g., 0.014-0.015" thick) is used to replace or supplant (with existing scooped former middle passage in place) the former round passage with a smooth open "D" shape (in cross-section) rotor-like middle passage. Monel, which is a high tensile strength nickel-copper alloy, is a trademark of Special Metals Corporation for a series of nickel alloys, primarily composed of nickel (up to 67%) and copper, with some iron and other trace elements. Small additions of aluminium and titanium form an alloy (K-500) with the same corrosion resistance but with much greater strength due to gamma prime formation on aging. Variations of Monel include Monel 400, 401, 404, K-500 and R-405. The sheet metal passage may be soft-soldered in place with excess material trimmed. The piston may be made straight and tested for roundness with final lapping done and valve guide reinstalled if replating is not needed. Replate as needed with, for example, nickel plate for resize and refit.

Also, the present invention may be used in fabricating new valves. A valve manufactured in accordance with the present invention is essentially a piston valve with two (upper and lower) through, hollow generally circular cross-section passages with no lumps or impedance bumps or such compromises in internal diameter or bore. The third or middle passage is not round but rather is u-shaped in cross-section and partially open along the outer surface of the valve piston. The middle passage is smooth and improves laminar flow of sound waves. The actual bore size through this middle passage may be reduced to a minor degree (approximately 5 percent less than prior art design). The profile of this passage is similar in appearance to an open sided letter "D" and is similar in some respects to a rotor valve passage. The invention has the benefit of improved design and performance with relatively minor adjustment to traditional Perinet valve manufacture. The upper and lower passages are formed with liners put into place as would be done with a traditional Perinet valve fabrication. However, preferably the upper and lower passages would not be brazed into place until all three windways are located. The middle passage would be formed by placing the trough insert, such as by removing the web or land in the valve body, if those holes are formed at that point, or by forming or cutting the recess in the valve body appropriately to receive the trough. The trough sheet metal would then either be hard- or soft-soldered into place, once both trough and sheet metal were formed. Similar grinding/lathe operations would then finish the valve. The middle passage is preferably made from thicker material or stock than the other cross or filler crook tubes. Another advantage of the invention is that it provides generous allowances or tolerances to accurately locate the final vertical perimeters of the middle passage.

Figure 4:
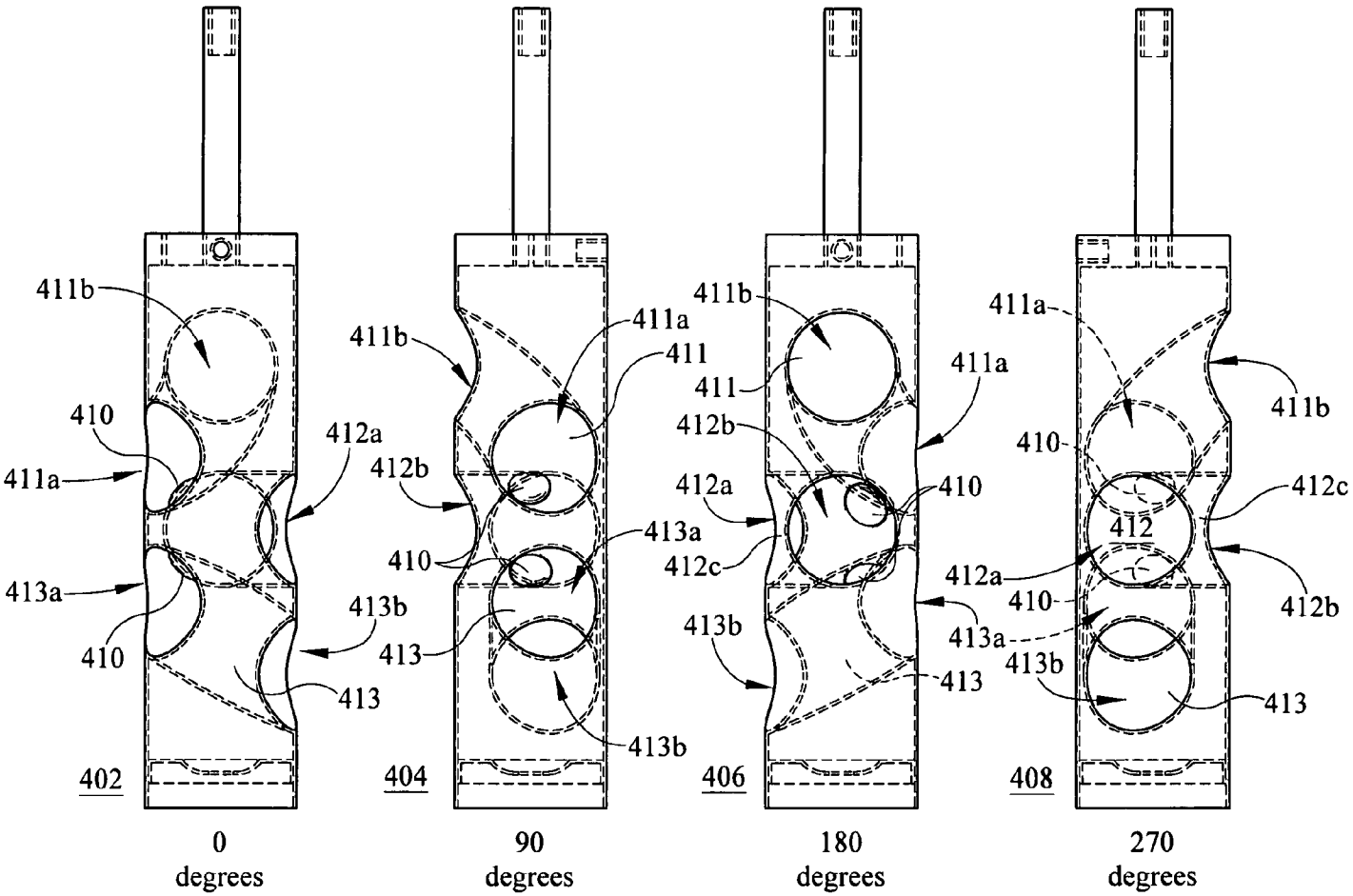
FIG. 4 is a series of views of a prior art Perinet valve at 0, 90, 180, and 270 degree positions.

FIG. 4 illustrates a series of views of a prior art Perinet valve at 0, 90, 180, and 270 degree positions, 402-408. The valve as shown is post-assembly with bumps 410 formed in the middle passageway 412. Upper passageway 411 is formed between openings 411*a* and 411*b*, middle passageway 412 is formed between openings 412*a* and 412*b*, and lower passageway 413 is formed between openings 413*a* and 413*b*. A land or web 412*c*, shown circled, extends laterally on the valve body between and in part connecting the middle passageway openings 412*a* and 412*b*.

Figure 5:
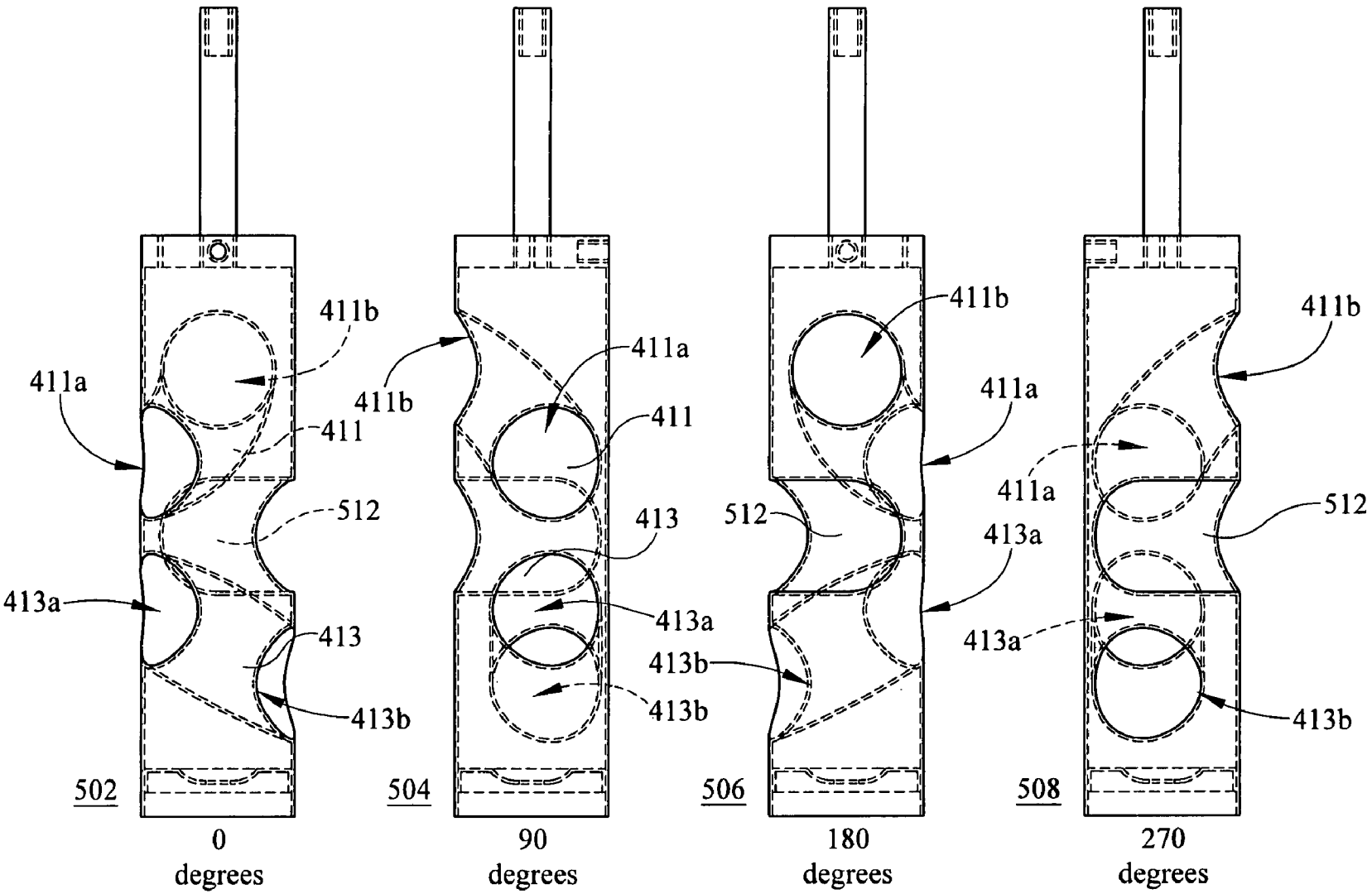
FIG. 5 is a series of views of a first embodiment of the present invention Perinet-type valve at 0, 90, 180, and 270 degree positions.

FIG. 5 is a series of views of one exemplary embodiment of the present invention Perinet-type valve at 0, 90, 180, and 270 degree positions 502-508. As shown, the closed middle passageway 412 is replaced with an open d-shaped passageway 512 in the valve body. As illustrated, the valve of the present invention is characterized by the absence of undesirable bumps or lumps in any of the passageways 411, 413 and 512. The material and thickness of material used to create the trough that is inserted to form middle passageway 512 should be of appropriate strength to provide structural integrity of the valve. Given that the valve is placed within a valve casing and generally only has lateral forces (up and down) acting on it, the removal of the land or web in the valve of the present invention lessens the physical demands and requirements of the valve. Nevertheless, the trough is preferably of a thickness greater than the filler crook thickness and is made of Monel material.

Figure 7:
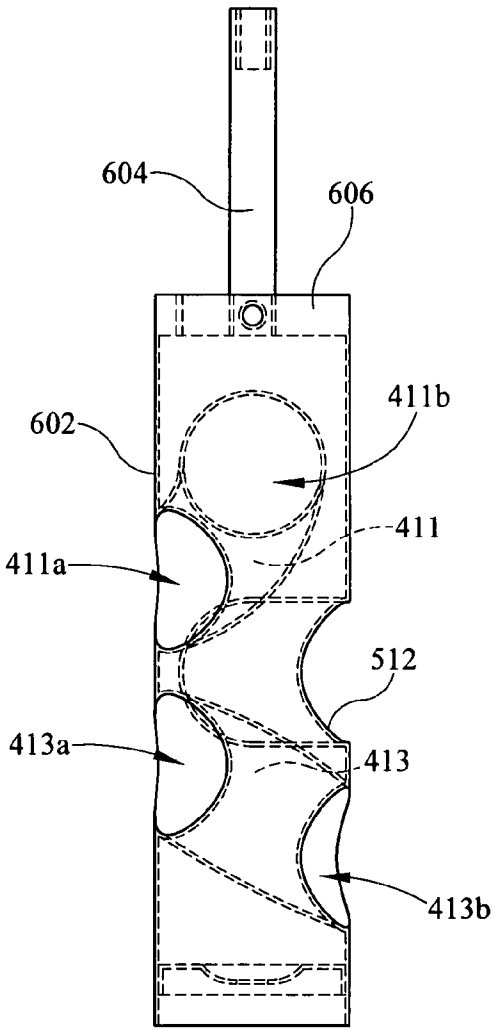
FIG. 7 is a perspective view of the inventive valve of FIG. 5.
Figure 6:
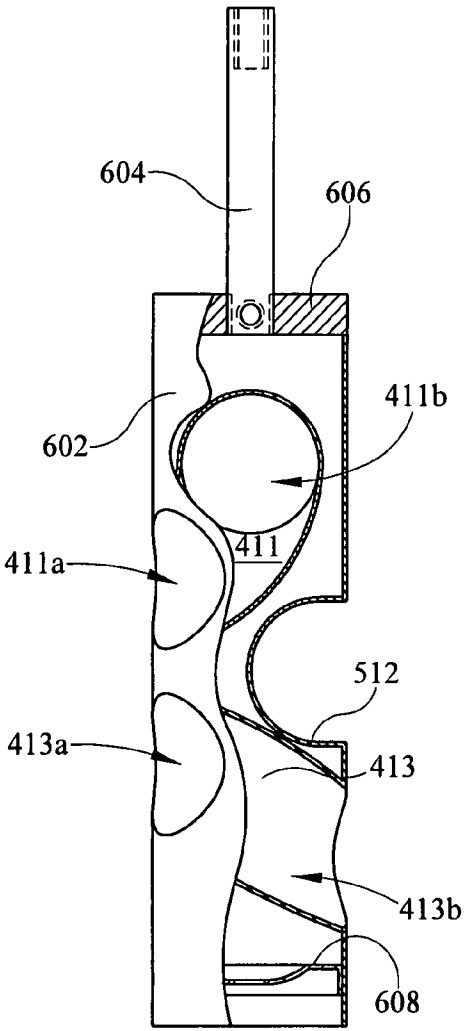
FIG. 6 is a partial cross-section of the inventive valve of FIG. 5.

FIG. 6 illustrates a partial cross-section of the inventive valve of FIG. 5 more clearly showing the cross-section of the trough that forms middle passage 512. Also shown is the upper and lower passages, 411 and 413, as well as the tubular nature of the generally hollow valve body 602 in combination with valve stem 604, touch-piece or finger tip (not shown), stem mount 606, and bottom cap 608 form the valve assembly that is placed in a valve casing. FIG. 7 is a perspective view of the inventive valve of FIG. 5. FIGS. 6 and 7 illustrate that the present invention allows for the valve to be fabricated while avoiding lumps or bumps in any of the passageways. While this is a desirable feature of the invention, there are other desirable features and it is contemplated that the invention could be incorporated into valve assemblies that do have lumps or bumps in one or more of the passageways.

FIG. 8 is a perspective view of a prior art valve piston body with windway passage holes formed therein. FIG. 9 is a perspective view of a partially completed prior art Perinet valve having a middle passageway 412 and land 412*c* formed therein as described above. Lumps 410 are shown and one or both may protrude into middle passageway 412 or one each into the upper and lower passageways associated with openings 411*a* and 413*a*. Lumps cause distortion of the column of air traveling through the valves and tubes of the wind instrument. Concentrating the lumps in one windway concentrates the distortive effect in that single passageway whereas distributing the lumps, and therefore the distortion associated with the lumps, in multiple windways may be preferred. FIG. 10 is a perspective view of a partially completed valve according to the present invention with a formed middle passageway or trough 512 as described above. FIG. 11*a* is an end view taken at the cross-section as shown of the partially completed prior art Perinet valve of FIG. 9 and showing a scooped passageway 412, the land or web 412*c*, and one of the lumps 410. FIG. 11*b* is an end view taken at the cross-section indicated on the partially completed valve of FIG. 10 in accordance with the present invention. In comparing the relative displacements of the scoop-shaped middle passageway 412 of FIG. 11*a* with the smooth, straight (preferably), i.e., non-scooped and of generally uniform depth, middle passageway 512 of FIG. 11*b*, it is readily seen that the invention may be used to advantageously reduce the extent to which the middle passageway extends into the hollow valve tube body and thereby alleviate some of the dimensional constraints associated with Perinet valve design and fabrication. In this manner lumps may be avoided altogether. In addition, by removing the land or web 412*c*, the overall volumetric capacity of the passage 512 is increased so as to offset the volumetric capacity lost associated with removing the scoop of traditional passage 412. The land or web may be removed because, in part, the valve casing that surrounds the valve body will serve to enclose the passageway during operation of the instrument.

It is fully contemplated by the present invention that the preferred passageway design may be modified and, depending on the instrument and valve/loop configuration, may be desirable. For instance, some degree of "scoop" may be incorporated into the passageway 512. Preferably, whatever degree of scoop is incorporated will not require lumps in the upper and lower passageways. Also, the generally "U" shaped passageway 512 as shown in the perspective of FIG. 10 may be "V" shaped or a variation of such shapes. In addition, a portion of the land or web 412*c* may be retained so that there is a graduated rounding of the trough at the outer circumference of the valve body, thereby giving the passageway more of a "C" shape in cross-section. This may reduce some of the volumetric gains associated with removing it altogether, but depending on the instrument and the particular valve and loop configuration there may be qualitative, e.g., sound/tonal quality, benefits. These are exemplary design factors that may be considered when incorporating the present invention in a wind instrument.

Figure 12:
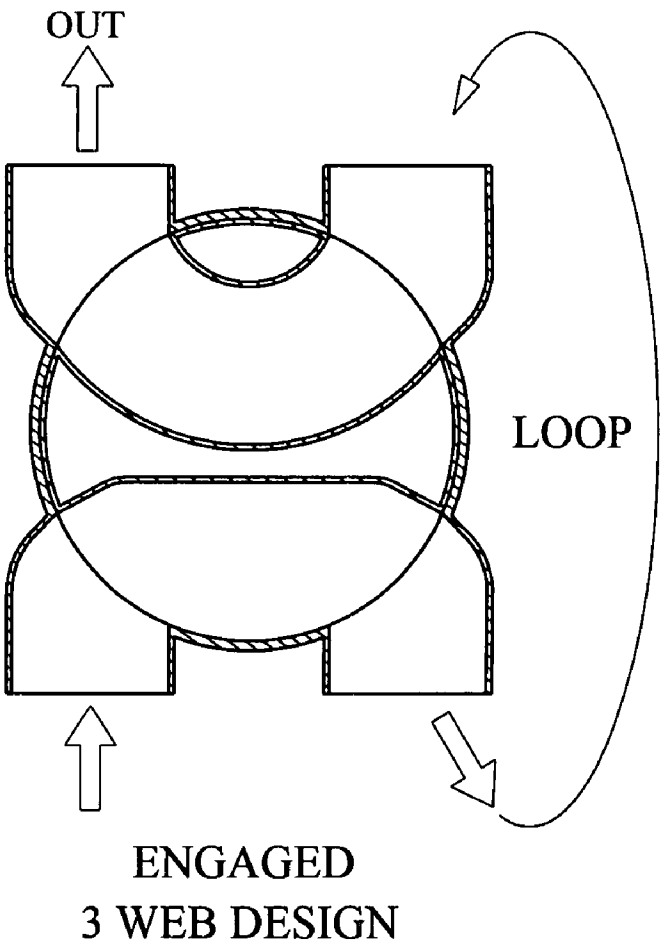
FIG. 12 is a pair of top-down views of a rotary valve application of the present invention shown in an at rest position on the left and in an engaged position on the right with respective windway flow paths.
Figure 12:
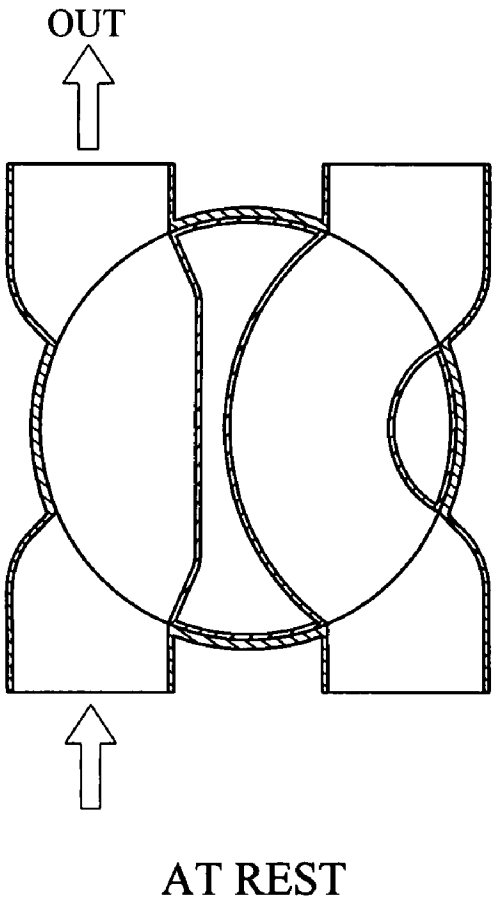

While the invention has been described in the context of piston valves, aspects of the invention may also be applied in rotary valves. FIG. 12 is a pair of top-down views of a rotary valve application of the present invention shown in an open or "at rest" position on the left and in an actuated or engaged position on the right with respective windway flow paths. A typical rotor or rotary valve has two "D" shaped passageways that are compressed and that distort the sound wave or column of air passing through them. This is true for both normal (non-webbed) rotors and Rotax (webbed) rotors—See FIG. 13. As shown on the left-side view of FIG. 12, the left most passage of the rotary valve is "compressed" in that the passage is generally a squeezed, oval shape in cross-section and not circular in cross-section. This is in large part due to the constraints associated with rotary valve and instrument design. Compressing the passageway to save space has the negative effect of distorting the column of air passing through that windway. In normal rotary valve design, both passageways are open (i.e., no land) and symmetric, both are compressed, and both result in unwanted sound distortion. An alternative rotary valve design is the Rotax design, see FIG. 13, that has all of the negative effects of the normal rotor valve but also has lands which further cause unwanted effects, especially disturbance and distortion when the lands act as a leading edge disruption force during transition from an engaged position to an unengaged position and vice-versa.

As shown in FIG. 12 and in keeping with the present invention, the other, non-compressed of the two passageways avoids or at least mitigates distortion by increasing the internal bore diameter and providing a generally circular in cross-section passageway. This passageway may be scooped or non-scooped with ramped transitions on the internal portions of the passageway leading into and out of the passageway. This may be achieved by enlarging the overall diameter of the rotary valve, which may be solid or hollow, and providing an asymmetric or offset internal passageway configuration, e.g., compare the centerline of the Rotax rotor (2) with the centerline of the inventive rotor (4). In one embodiment, the improved rotor is D-shaped on one side (without a land or web) while circular-shaped or a round passage with a web on the other side/passage. In this embodiment, the rotation of the valve may be configured in combination with the tubing and instrument operation to avoid a leading edge disruption during valve actuation. In the alternative, both the webs of both passageways may be removed, in whole or in part. By removing the web of the second passage, the sound may be affected by the non-circular nature of the passageway, but depending on the instrument and operation, the additional volumetric capacity achieved be removing the material associated with the web may be a more desirable advantage. Thus, the invention may be implemented in a three-web design or a two-web design.

Figure 13:
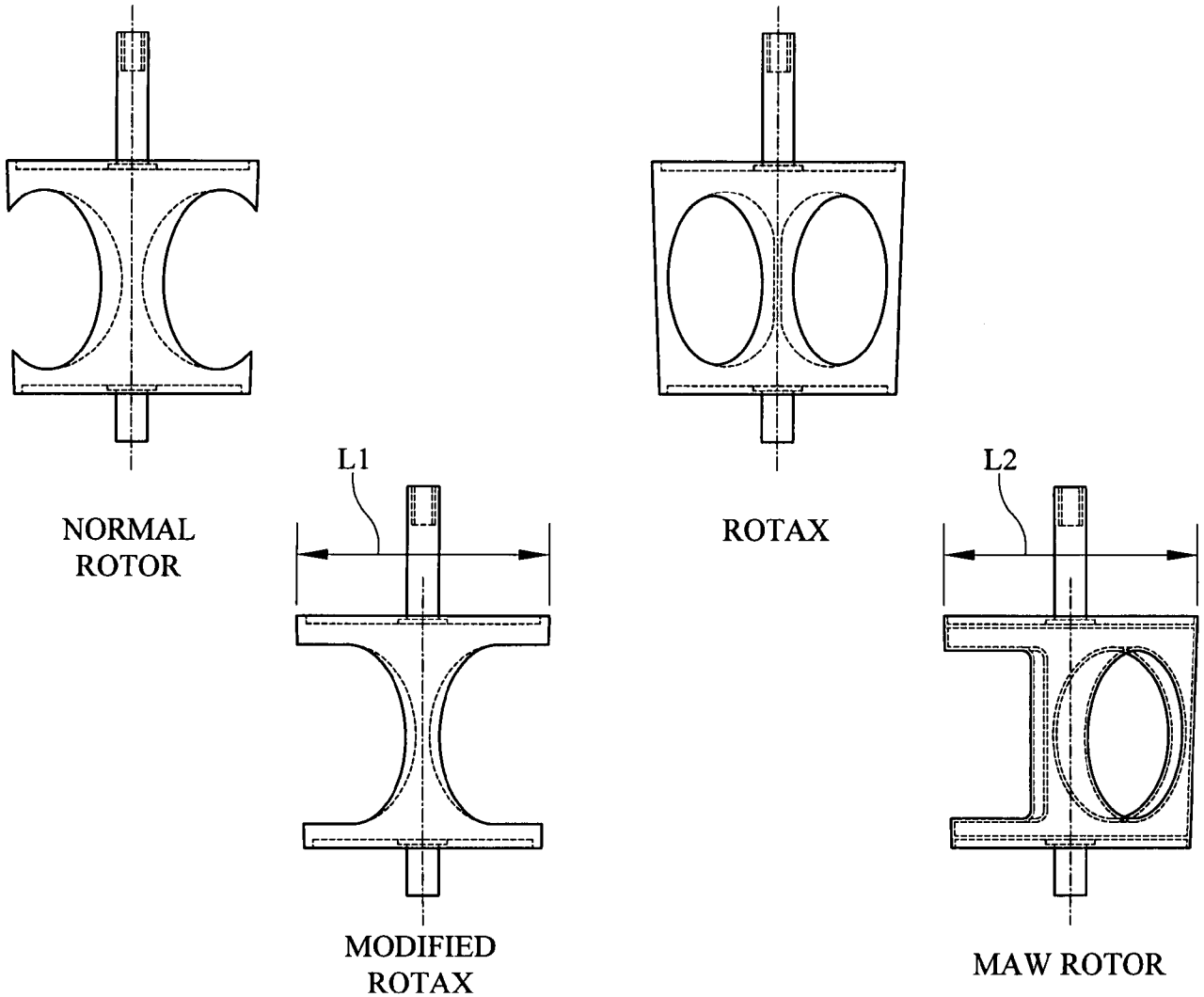
FIG. 13 is sequence of perspective views of rotary valves contrasting aspects of the present invention.

FIG. 13 is sequence of perspective views of rotary valves contrasting aspects of the present invention Although the rotor valves shown in FIG. 13 are of the tapered variety, the invention may be used in straight-bodied rotary valves as well. The rotor at 3 is a modified Rotax rotor in which the lateral webs that connect each pair of passageway openings is removed and the internal bore size is increased. The rotor at 4 is an improved rotor with a relatively increased diameter (L2 as compared with L1 of rotor (3)) and an offset in the two passageways, i.e., an asymmetric design. For example, the relative increase in diameter of the rotor from a normal design to the improved design may be in the range of 15-30%. As shown, the centerline of the valve cuts through the passageway having the circular cross-section and increased bore size that mitigates distortion associated with the compressed passageway of the normal rotor design. Again, the land may be removed in whole or in part from the enlarged passageway (rightmost of rotor (4) in FIG. 13), depending on the design consideration tradeoffs. In any event, the benefits associated with the inventive aspect of providing an asymmetric passageway configuration to address constraints in rotor design to avoid distortion may still be enjoyed.

In one embodiment, the present invention provides a valve assembly designed to regulate air flow through a musical instrument. The valve assembly comprises: a) a cylindrical-shaped valve casing having openings formed therein that define at least one ingress and at least one egress through which vibrating columns of air pass; and b) a valve piston received within the valve casing and linearly displaceable therein, the valve piston comprising at least one passageway having a cross-section that is open and u-shaped, whereby other passageways formed in the valve piston are bump-free.

In one embodiment, the present invention provides a valve piston of the Perinet type for use in a musical wind instrument. The valve piston includes: an essentially cylindrical hollow piston body adapted to be received in a valve casing of a musical instrument, the piston body having a coordinated series of openings; through pairs of which openings passages are formed; the valve casing having at least one inlet port and at least one outlet port; and at least one passage characterized by the absence of a land and being open whereby the passageways may be collectively fabricated free of lumps generally associated with passageway design and construction. A valve piston having a first passage defined therein, a second passage defined therein, and a third passage defined therein, at least one of the first, second and third passages having a substantially straight passage with an open, u-shaped cross-section.

In another embodiment, the present invention provides a valve assembly designed to regulate air flow through a musical instrument. The valve assembly comprises: a) a cylindrical-shaped valve casing having openings formed therein that define at least one ingress and at least one egress through which vibrating columns of air pass; and b) a rotary valve received within the valve casing and rotatably displaceable therein, the rotary valve comprising at least one passageway having a substantially circular cross-section that mitigates distortion.

In yet another embodiment, the present invention provides a valve assembly designed to regulate air flow through a musical instrument. The valve assembly comprises: a) a cylindrical-shaped valve casing having openings formed therein that define at least one ingress and at least one egress through which vibrating columns of air pass; and b) a rotary valve received within the valve casing and rotatably displaceable therein, the rotary valve comprising a pair of passageways formed asymmetrically in the body of the rotary valve and at least one of the pair of passageways having a substantially circular cross-section. The rotary valve being further characterized with a land between opening of one of the pair of passageways and the absence of a land for the other of the pair of passageways.

The present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

What is claimed is:

1. A valve assembly designed to regulate air flow through a musical instrument, the valve assembly comprising:

a cylindrical-shaped valve casing having openings formed therein that define at least one ingress and at least one egress through which vibrating columns of air pass; and a valve piston received within the valve casing and linearly displaceable therein, the valve piston comprising at least one passageway having a cross-section that is open and u-shaped, whereby other passageways formed in the valve piston are essentially bump-free.

2. The valve assembly of claim 1, wherein the at least one passageway is made of one of the group consisting of nickel-copper alloy, brass, brass alloy, nickel alloy, nickel-silver, stainless steel, and bronze.

3. The valve assembly of claim 1, wherein the at least one passageway extends more than halfway into the valve piston.

4. The valve assembly of claim 1, wherein the at least one passageway is formed of material having a greater tensile strength than the material that forms the other passageways.

5. The valve assembly of claim 1, wherein the valve piston is spring biased and in operation transitions by manual actuation from an open position to an activated position to thereby switch the flow of a vibrating column of air from an open passageway to a switched passageway.

6. The valve assembly of claim 1, wherein the at least one passageway is essentially linear across the valve piston, and wherein the other passageways comprise a curved path through the piston valve.

7. A valve piston of the Perinet type for use in a musical wind instrument and to be received in a valve casing having at least one inlet port and at least one outlet port, the valve piston comprises:

an essentially cylindrical hollow piston body adapted to be received in a valve casing;

a coordinated series of openings formed in the piston body through pairs of which openings a plurality of passageways are formed; and at least one passageway characterized by the absence of a land and being open whereby the plurality of passageways may be collectively fabricated essentially lump-free.

8. The valve piston of claim 7, wherein the at least one passageway is made of one of the group consisting of nickel-copper alloy, brass, brass alloy, nickel alloy, nickel-silver, stainless steel, and bronze.

9. The valve piston of claim 7, wherein the at least one passageway extends more than halfway into the piston body.

10. The valve piston of claim 7, wherein the at least one passageway is formed of material having a greater tensile strength than the material that forms the other passageways.

11. The valve piston of claim 7, wherein the valve piston is spring biased and in operation transitions by manual actuation from an open position to an activated position to thereby switch the flow of a vibrating column of air from an open passageway to a switched passageway.

12. The valve piston of claim 7, wherein the at least one passageway is essentially linear across the valve piston, and wherein the other passageways comprise a curved path through the piston valve.

13. A valve piston having a first passage defined therein, a second passage defined therein, and a third passage defined therein, at least one of the first, second and third passages having a substantially straight passage with an open, u-shaped cross-section, whereby the first, second and third passageways may be collectively fabricated essentially lump-free and thereby avoiding lump-based discontinuity associated with passageway design and construction.

14. The valve piston of claim 13, wherein the at least one of the first, second and third passages is made of one of the group consisting of nickel-copper alloy, brass, brass alloy, nickel alloy, nickel-silver, stainless steel, and bronze.

15. The valve piston of claim 13, wherein the at least one of the first, second and third passages extends at least in part more than halfway into the piston.

16. A valve assembly designed to regulate air flow through a musical instrument, the valve assembly comprising:

a cylindrical valve casing having openings formed therein that define at least one ingress and at least one egress through which vibrating columns of air pass; and a rotary valve received within the valve casing and rotatably displaceable therein, the rotary valve comprising at least one passageway having a substantially circular cross-section that mitigates distortion.

17. A valve assembly designed to regulate air flow through a musical instrument, the valve assembly comprising:

a cylindrical-shaped valve casing having openings formed therein that define at least one ingress and at least one egress through which vibrating columns of air pass; and a rotary valve received within the valve casing and rotatably displaceable therein, the rotary valve comprising a pair of passageways formed asymmetrically in the body of the rotary valve and at least one of the pair of passageways having a substantially circular cross-section.

18. The valve assembly of claim 17, wherein the rotary valve comprises a land between an opening of one of the pair of passageways and the absence of a land for the other of the pair of passageways.

19. A method for manufacturing a valve piston received in a valve casing of a musical wind instrument, the method comprising:

removing from an existing hollow valve body having openings formed therein a land formed between a first pair of openings so as to form a first cavity adapted to receive a first passageway;

inserting into and affixing to the valve body a generally hollow filler crook between a second pair of openings so as to form a second passageway in the valve body; and inserting and affixing to the valve body within the first cavity an open, generally u-shaped trough to form a first passageway, the trough being configured with sufficient clearance internal to the valve body so as to not cause a lump to form in the second passageway when fitted in the valve body.

20. The method of claim 19 further comprising inserting into and affixing to the valve body a generally hollow filler crook between a third pair of openings so as to form a third passageway in the valve body, the trough being configured with sufficient clearance internal to the valve body so as to not cause a lump to form in either of the second and third passageways when fitted in the valve body.

21. The method of claim 19, wherein the trough cross-section extends more than halfway into the valve body.

22. The method of claim 19, wherein the trough is made of one of the group consisting of nickel-copper alloy, brass, brass alloy, nickel alloy, nickel-silver, stainless steel, and bronze.

23. A method for reconfiguring a valve piston received in a valve casing of a musical wind instrument, the method comprising:

removing a land formed in an existing valve piston and that defines part of a first passageway thereby rendering the first passageway open;

removing the material internal to the valve piston that forms the first passageway;

removing lumps formed in one or more other passageways formed in the valve piston; and inserting and affixing to the valve piston an open, generally u-shaped replacement first passageway configured with sufficient clearance internal to the valve piston so as to not cause one or more lumps to form in the one or more other passageways when fitted in the valve piston.

24. The method of claim 23, wherein the replacement first passageway is made of one of the group consisting of nickel-copper alloy, brass, brass alloy, nickel alloy, nickel-silver, stainless steel, and bronze.

25. The method of claim 23, wherein the replacement first passageway at least in part extends more than halfway into the valve piston.

* * * * *